US005769410A

United States Patent [19]

Davidson et al.

[11] Patent Number: 5,769,410

[45] Date of Patent: Jun. 23, 1998

[54] LIFT AND DRIVE ACTUATORS FOR FEEDER CRU

[75] Inventors: Harry A. Davidson; Donald J. Lyon, both of Macedon, N.Y.

[73] Assignee: Xerox Corporation, Stamford, Conn.

[21] Appl. No.: 715,740

[22] Filed: Sep. 19, 1996

[51] Int. Cl.[6] ..... B65H 3/06

[52] U.S. Cl. ..... 271/109; 403/322; 403/325; 271/274; 271/314; 271/273

[58] Field of Search ..... 271/272, 273, 271/274, 109, 117, 314; 226/154, 174, 168; 403/321, 322, 325

[56] References Cited

U.S. PATENT DOCUMENTS

| | | | |
|---|---|---|---|
| 5,156,388 | 10/1992 | Morita | 271/109 |
| 5,265,859 | 11/1993 | Watson et al. | 271/109 |
| 5,421,569 | 6/1995 | Davidson | 271/109 |

FOREIGN PATENT DOCUMENTS

| | | | |
|---|---|---|---|
| 0125538 | 7/1983 | Japan | 271/109 |
| 404041339A | 2/1992 | Japan | 271/109 |
| 40615676A | 6/1994 | Japan | 271/109 |

*Primary Examiner*—H. Grant Skaggs
*Attorney, Agent, or Firm*—Kevin R. Kepner

[57] ABSTRACT

A lift and interlock actuator mechanism for installing a CRU in a printing machine. There is provided a lift and interlock actuator mechanism which has a sliding planar member which is moved from a first position to a second position to remove and/or install a feed head CRU in a printing machine. The planar member creates an interlock which prevents the CRU from being removed or installed when the corresponding drive components are in the wrong position. Sliding of the planar member disengages a drive coupling from the CRU and also causes a lift mechanism to pivot the CRU about the drive shaft causing the CRU to be moved to a position for easy removal. To install the CRU the planar member is slid to the second position the CRU is placed into position and rotated down, allowing the planar member to slide back to the first position. This sliding allows the drive coupling to mesh and allows the CRU to rrotate into the home position. To operate the feed head a soloenoid moves the CRU into a feed position which places the nudger roll on a stack of sheets to be fed. The lift and interlock actuator mechanism described herein allows for easy one handed removal of the CRU and prevents the CRU from being improperly installed.

6 Claims, 4 Drawing Sheets

LIFT AND DRIVE ACTUATORS FOR FEEDER CRU

This invention relates generally to a cut sheet feeder, and more particularly concerns a device for installing and removing a customer replaceable feed/retard roll CRU (customer replaceable unit) assembly in a cut sheet feeder in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In printing machines such as those described above, semi-active retard paper feeders are used in document handlers, special material handlers, and in paper supply trays. As currently configured, the feed rollers, when worn, must be replaced by a service technician as a result of designs requiring disassembly of the feed head and replacement of several parts in several different areas in the feeder assembly. It is desirable to have a machine in which the feed head components, namely a nudger roller, a feed roller, a retard roll or pad, are easily replaceable by a customer. This easy replacement allows the customer to avoid a service technician call and also provides that the feed head components can be easily replaced by the customer when worn without down time.

It is also desirous to have a feed head replacement component that is low in cost and somewhat universal so as to be able to be used in different locations throughout the printing machine. It is further desirable to have a feed head replacement component which does not require extensive adjustment and/or disassembly of the printing machine for replacement.

The following disclosures appear to be relevant:

U.S. Pat. No. 5,421,569

Inventor: Davidson

Issue Date: Jun. 6, 1995

U.S. Pat. No. 5,265,859

Inventor: Watson et al.

Issue Date: Nov. 30, 1993

Portions of the foregoing patents and application may be summarized as follows:

U.S. Pat. No. 5,421,569 discloses a replacement roller cartridge for a cut sheet retard feeder. The cartridge assembly includes a feed roll, a nudger role, and a retard roll aligned so that the axis of rotation are substantially in the same plane within a frame. The frame is inserted into the feed head and pivoted into an active position which causes the retard roll to separate from the frame and form a nip with the feed roll.

U.S. Pat. No. 5,265,859 describes a roller assembly having first and second rollers connected by a gear train. The driven roller is biased toward a drive connection and the entire assembly snap-fits into a feed head cover.

In accordance with one aspect of the present invention, there is provided an electrophotographic printing machine having a customer replaceable feed roll assembly, comprising an interlock device and a lift mechanism, cooperating with said interlock device, to raise the replaceable feed roll assembly when said interlock device is moved from a first position to a second position.

In accordance with another aspect of the invention, there is provided An apparatus for replacing a feed roll assembly in an electrophotographic printing machine, comprising an interlock device and a lift mechanism, cooperating with said interlock device, to raise the replaceable feed roll assembly when said interlock device is moved from a first position to a second position.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
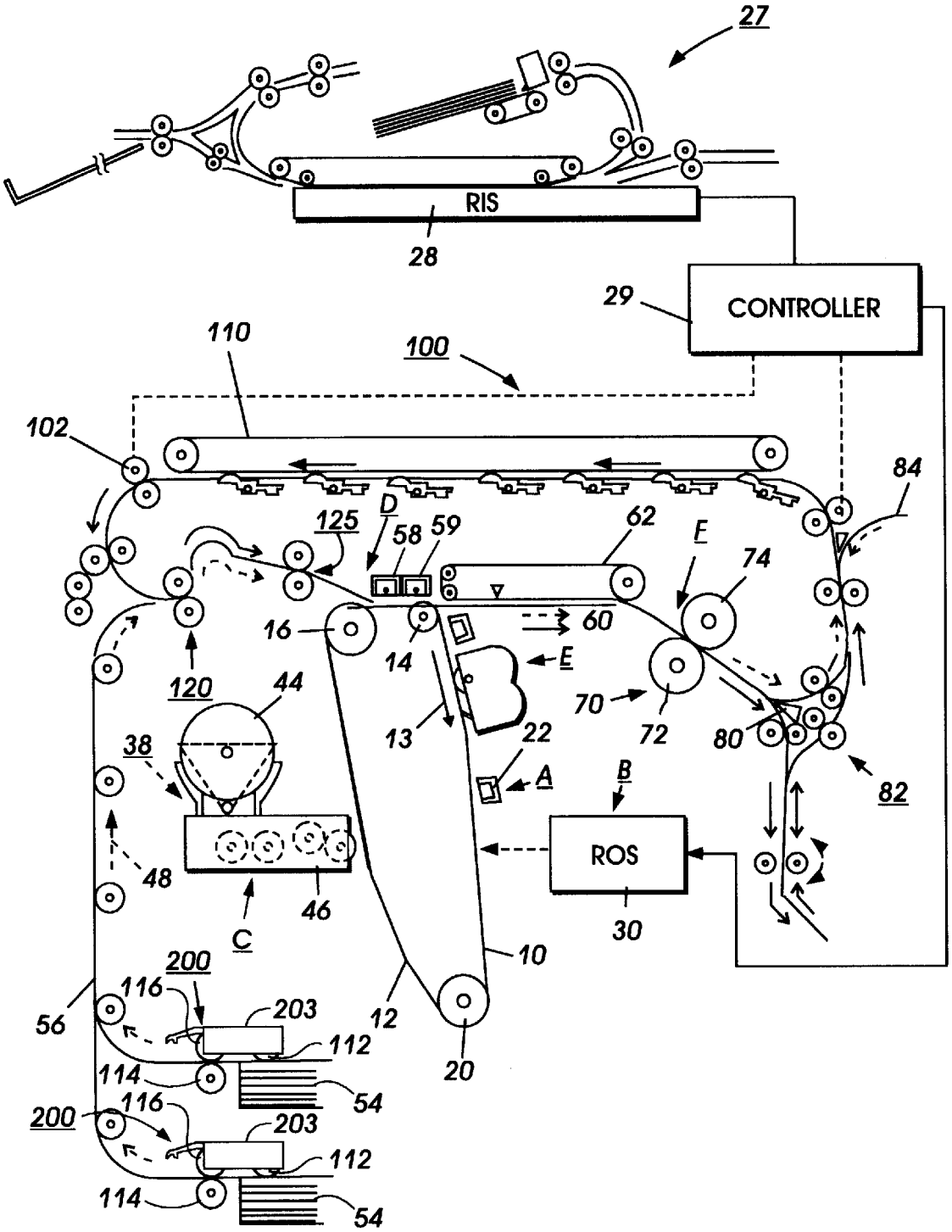
FIG. 1 is a schematic elevational view of a typical electrophotographic printing machine utilizing the invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor (not shown).

With continued reference to FIG. 1, after the electrostatic latent image is developed, the toner powder image present on belt 10 advances to transfer station D. A print sheet 48 is advanced to the transfer station, D, by a sheet feeding apparatus, 203 including the interlocking mechanism 200 described below. Preferably, sheet feeding apparatus 203 includes a nudger roll 112 contacting the uppermost sheet of stack 54. Nudges roll 112 rotates to advance the uppermost sheet from stack 54 into the nip formed by feed roll 116 and retard roll 114 which then feed the sheet to vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described including toner dispensing. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the features of the present invention therein.

Figure 2:
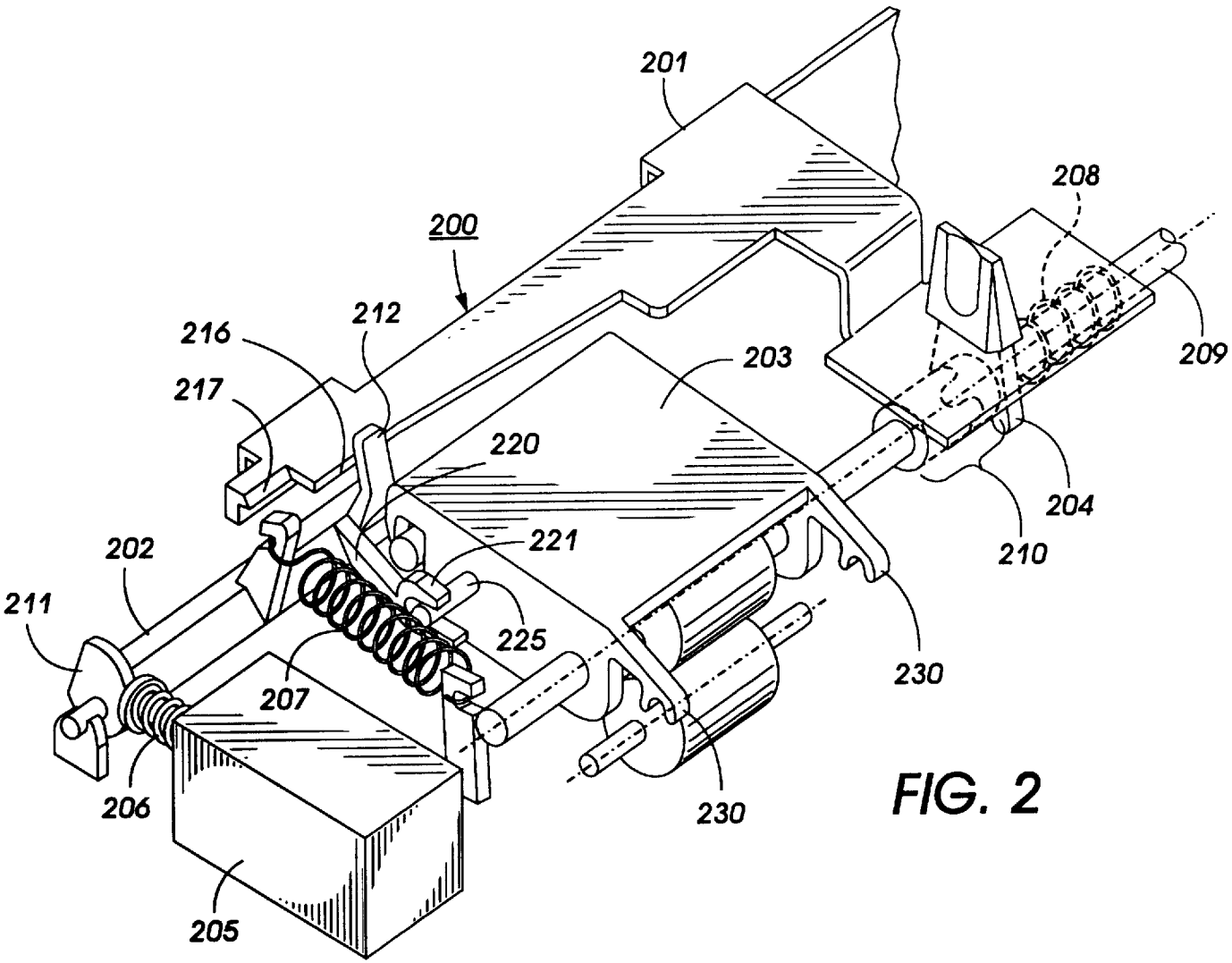
FIG. 2 is a perspective view of the invention herein with the interlock device in a first position.

Turning now to FIG. 2, there is illustrated a perspective view of the feeder CRU interlock and installation mechanism 200. The CRU 203 is shown in the installed position. The feeder roll 116 is driven by drive coupling 210 which connects with drive shaft 209. The interlock mechanism 201 includes a plate which covers the drive coupling 210 when the CRU is in the operative position. Spring 208 biases the drive coupling 210 into a positive driving position as shown in FIG. 2. There is a lift mechanism made up of solenoid 205, conical spring 206, lift shaft 202, lever 211, lift arm 220 and spring 207. The lift arm 220 has a tined end 221 which cooperates with a pin 225 located on the CRU. The interlock mechanism 201 includes a surface 216 which allows a tab 212 located on lift shaft 202 to remain in a position that prevents the CRU from being removed.

Figure 3:
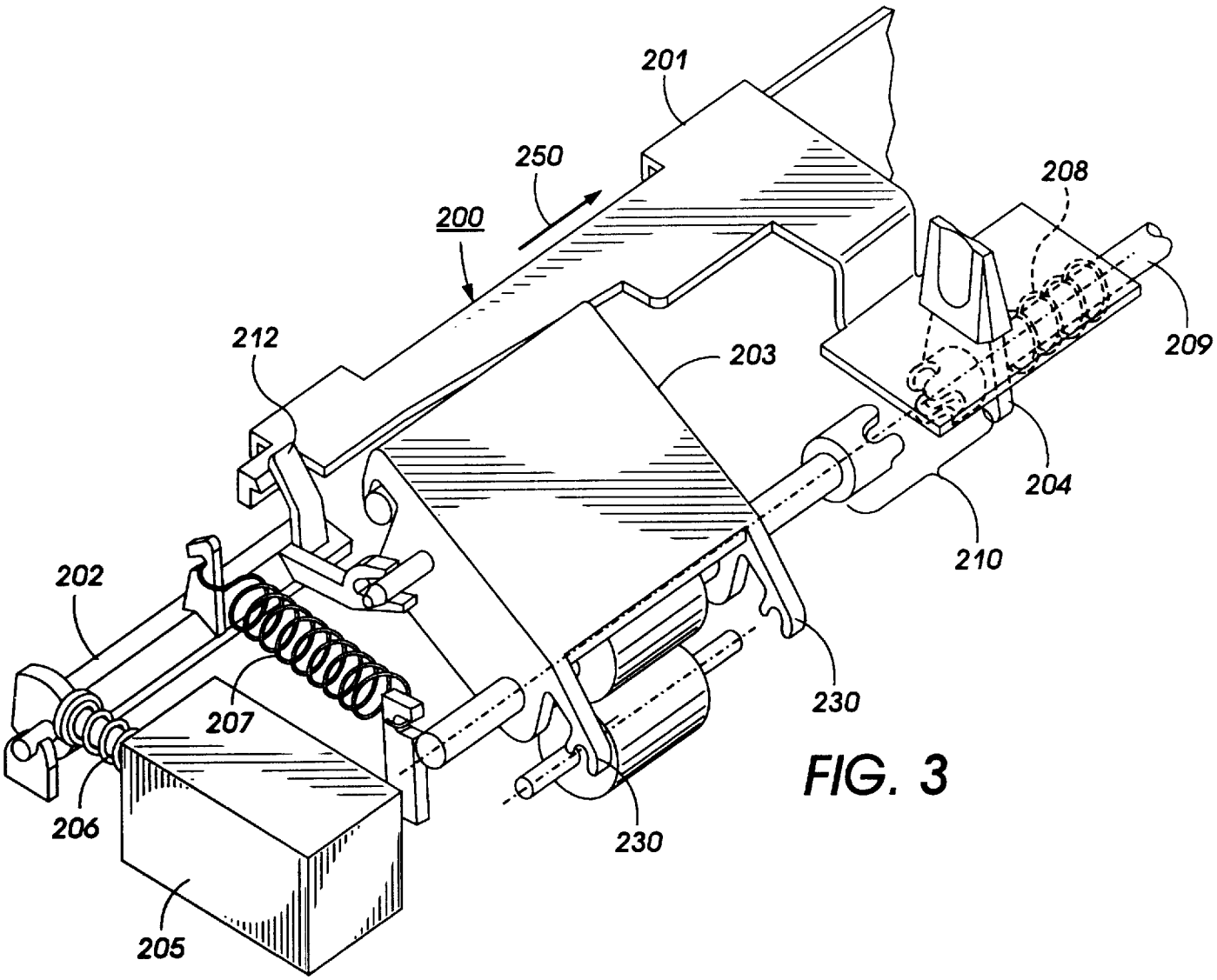
FIG. 3 is a perspective view of the invention herein with the interlock device in a second position.

Turning next to FIG. 3 there is shown the same perspective view as FIG. 2 with the CRU in the removal position. In operation, the interlock mechanism 201 is slid laterally in the direction of arrow 250 which causes the protrusion or saddle 204 to overcome the bias of spring 208 to disengage drive coupling 210 from the CRU 203. As the interlock mechanism is slid laterally the tab 212 located on the lift shaft 202 is allowed to move along surface 216 of the interlock until it moves over the step onto surface 217. The conical spring 206 which acts as an actuator causing the plunger of the solenoid to move outward moving the arm 211 attached to shaft 202 thereby raising lift arm 220. This motion causes the CRU to rotate about the drive shaft 209 as the tined end 221 of lift arm 220 pushes up on pin 225 of the CRU. As described in U.S. Pat. No. 5,421,569, the relevant portions of which are herein incorporated by reference, the user can then rotate the CRU until the retard roll 114 is captured by the arms 230 of the CRU and can then remove the feed roll CRU unit.

Figure 4:
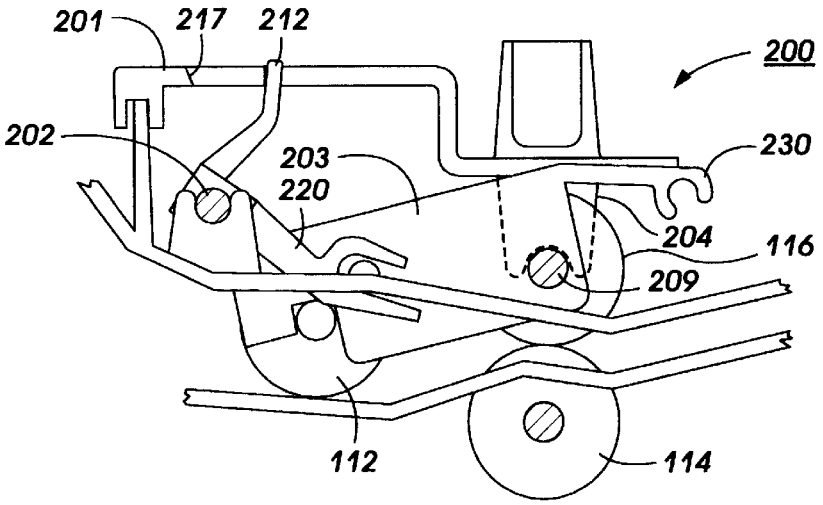
FIG. 4 is a side elevational view of the feed roll assembly and the lift and interlock actuator device herein showing the feed head in the feed position.
Figure 5:
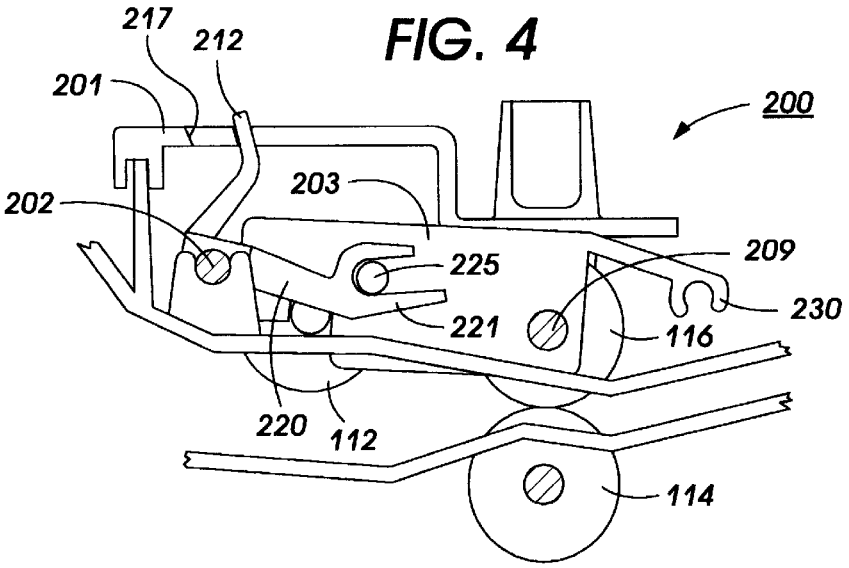
FIG. 5 is a side elevational view of the feed roll assembly and the lift and interlock actuator device herein showing the feed head in the home position.
Figure 6:
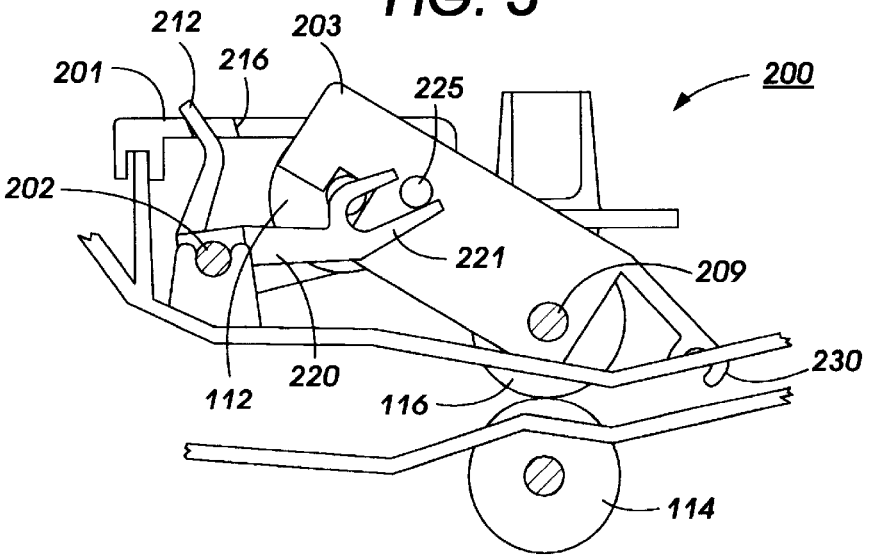
FIG. 6 is a side elevational view of the feed roll assembly and the lift and interlock actuator device herein showing the feed head in the removal position.

FIGS. 4, 5 and 6 illustrate a schematic side view of the three main operating positions of the lift and interlock actuator devices described herein. As shown in FIG. 4 when the unit is in the feed position the biasing is provided by spring 207 with the solenoid activated to overcome the reverse biasing force of conical spring 206. When the solenoid is deactivated, spring 206 pushes the lever 211 which causes tab 212 to contact surface 216 as illustrated in FIG. 5. FIG. 6 illustrates the removal position at which time planar member 201 is moved to one side, which causes saddle 204 to disengage coupling 210 (FIGS. 2 and 3) and further allows tab 212 to contact surface 217 which causes arm 220 to raise the CRU to the removal position.

In recapitulation, there is provided a lift and interlock actuator mechanism for installing a CRU in a printing machine. There is provided a lift and interlock actuator mechanism which has a sliding planar member which is moved from a first position to a second position to remove and/or install a feed head CRU in a printing machine. The planar member creates an interlock which prevents the CRU from being removed or installed when the corresponding drive components are in the wrong position. Sliding of the planar member disengages a drive coupling from the CRU and also causes a lift mechanism to pivot the CRU about the drive shaft causing the CRU to be moved to a position for easy removal. To install the CRU the planar member is slid to the second position the CRU is placed into position and rotated down, allowing the planar member to slide slid back to the first position. This sliding allows the drive coupling to mesh and rotates the CRU into a home position. To operate the feed head a solenoid moves the CRU into a feed position which places the nudger roll on a stack of sheets to be fed. The lift and interlock actuator mechanism described herein allows for easy one handed removal of the CRU and prevents the CRU from being improperly installed.

It is, therefore, apparent that there has been provided in accordance with the present invention, a CRU lift and interlock actuator mechanism that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An electrophotographic printing machine having a customer replaceable feed roll assembly, comprising;

a print engine which receives sheets from the feed roll assembly for marking images thereon;

an interlock device;

a lift mechanism, cooperating with said interlock device, to raise the replaceable feed roll assembly when said interlock device is moved from a first position to a second position, wherein said interlock device comprises a planar member, said planar member having a protrusion attached to a drive coupling, wherein said drive coupling mates with the replaceable feed roll assembly when said planar member is in the first position wherein said lift mechanism comprises an actuator to cause said lift mechanism to raise a portion of said feed roll assembly when said planar member is moved to the second position.

2. An electrophotographic printing machine having a customer replaceable feed roll assembly, comprising;

a print engine which receives sheets from the feed roll assembly for marking images thereon;

an interlock device, a lift mechanism, cooperating with said interlock device, to raise the replaceable feed roll assembly when said interlock device is moved from a first position to a second position, wherein said lift mechanism comprises an elongated member having a first end and a second end, a first lever member, attached to the first end of said elongated member and a second lever member, attached to the second end of said elongated member and cooperating with said feed roll assembly to raise a portion of the feed roll assembly when said first lever member is moved from the first position to the second position.

3. A printing machine according to claim 2, wherein said lift mechanism further comprises a third member attached to said elongated member, said third member cooperating with said planar member to limit movement of said elongated member to the first and second positions.

4. An apparatus for replacing a feed roll assembly in an electrophotographic printing machine, comprising;

an interlock device, a lift mechanism, cooperating with said interlock device, to raise the replaceable feed roll assembly when said interlock device is moved from a first position to a second position, wherein said interlock device comprises a planar member, said planar member having a protrusion attached to a drive coupling, wherein said drive coupling mates with the replaceable feed roll assembly when said planar member is in a first position, wherein said lift mechanism comprises an actuator to cause said lift mechanism to raise a portion of said feed roll assembly when said planar member is moved to a second position.

5. An apparatus for replacing a feed roll assembly in an electrophotographic printing machine, comprising;

an interlock device;

a lift mechanism, cooperating with said interlock device, to raise the replaceable feed roll assembly when said interlock device is moved from a first position to a second position, wherein said lift mechanism comprises an elongated member having a first end and a second end, a first lever member, attached to the first end of said elongated member and a second lever member, attached to the second end of said elongated member and cooperating with said feed roll assembly to raise a portion of the feed roll assembly when said first lever member is moved from a first position to a second position.

6. An apparatus according to claim 5, wherein said lift mechanism further comprises a third member attached to said elongated member, said third member cooperating with said (planar member) interlock device to limit movement of said elongated member to the first and second positions.

* * * * *